United States Patent [19]

Frantz

[11] 4,050,611

[45] Sept. 27, 1977

[54] DEVICE FOR FILLING CRANK CASE OR TRANSMISSION OF INTERNAL COMBUSTION ENGINE WITH OIL

[76] Inventor: Joseph F. Frantz, 495 S. Dayton St., Denver, Colo. 80231

[21] Appl. No.: 650,470

[22] Filed: Jan. 19, 1976

[51] Int. Cl.[2] ..... B67B 7/28

[52] U.S. Cl. ..... 222/88; 210/222; 222/478

[58] Field of Search ..... 222/83.5, 86, 88, 478; 210/222

[56] References Cited

U.S. PATENT DOCUMENTS

| | | | |
|---|---|---|---|
| 2,246,419 | 6/1941 | Luce | 222/83.5 |
| 2,983,385 | 5/1961 | Botstiber | 210/222 |
| 3,190,511 | 6/1965 | Daly | 222/478 |
| 3,657,828 | 11/1953 | Crippen | 222/83.5 |
| 3,676,732 | 4/1954 | Greenwood | 222/86 |

*Primary Examiner*—Robert B. Reeves
*Assistant Examiner*—Francis J. Bartuska
*Attorney, Agent, or Firm*—Bertha L. MacGregor; Kyle W. Rost

[57] ABSTRACT

A device for filling the crank case or transmission of an internal combustion engine with oil dispensed from a can opened by the device. The device comprises an outer casing, a cup member in the casing spaced from the side walls and bottom of the casing, registering openings in the cup member and casing bottoms, and a piercing and dispensing tube mounted in the cup member having a beveled piercing end facing upwardly in the cup member. Air passages are provided by the space between the cup member and casing communicating with the interior of the piercing tube. The tube is mounted in the cup member by a pin of magnetic material which has two functions: to attract ferrous matter and to separate the fluid flow momentarily, thereby allowing air passing upwardly or downwardly with the fluid, to mix with the fluid. The spacing means between the cup member and the casing may be a plurality of bars connected to the side walls of the cup member and having legs extending beyond the cup member bottom. A cover may be provided for closing the open tops of the casing and cup member when not in use.

4 Claims, 4 Drawing Figures

DEVICE FOR FILLING CRANK CASE OR TRANSMISSION OF INTERNAL COMBUSTION ENGINE WITH OIL

BACKGROUND OF THE INVENTION

This invention relates to a device for filling the crank case or transmission of an internal combustion engine with oil. The oil is dispensed from a can opened by the device. For use for filling a crank case, the device may be mounted in pouring position on the crank case intake pipe and left in that position for future use. Contamination of the user's hands is avoided completely.

It is known in the art to employ a piercing tube by which the top of the oil can is punctured and the can and tube are inverted and then positioned on the upper end of the crank case intake pipe. This method of filling the crank case is objectionable due to spillage of the oil and soiling of the operator's hands, as well as the engine during the inverting and placement. Various forms of funnels have been employed for this purpose, but all require handling for initial placement of an opened inverted oil can and later removal of the oil contaminated devices.

An example of such prior art devices is U.S. Pat. No. 1,998,164 which discloses an oil can opening and pouring device that employs a combination boot and piercing tool. This also requires placement of the device on the top of the oil can, followed by inverting of the device and can and placement on the crank case intake pipe. This of course results in spillage during the placement step of the mounting. The salient feature of said prior art disclosure is the mutilation of the oil can by puncturing to provide an air inlet to facilitate pouring of the contents.

OBJECTS OF THE INVENTION

An object of the invention is to provide an oil dispensing device which is mountable on the crank case or transmission housing of an internal combustion engine. It is useful also for oil filling of other mechanisms, but its most obvious use has been found with internal combustion engines.

Another object is to provide means for covering the device such that it may be retained in its ready-to-use position on the engine.

Another object is to provide a construction which ensures quick dispensing of the oil from the container.

Another object is to produce a device for the purposes stated by which oil is poured from a can into the engine part without spillage, and without soiling of the exterior of the device or engine.

SUMMARY OF THE INVENTION

The device for filling the crank case or transmission of an internal combustion engine with oil comprises an outer casing provided with side walls and a bottom having an opening therein, an inner cup shaped member provided with openings in its bottom, means spacing it from the bottom and side walls of the outer casing, a can piercing tube extending through the bottom opening of the casing and a bottom opening in the cup, said tube having beveled cutter edge upper end in the cup member and a lower end extending downwardly through the bottom opening in the casing into a sleeve depending from the bottom of the casing. A pin of magnetic material extends through the piercing tube and retains it in its intended position relatively to the cup member. The pin also serves to separate the fluid flow momentarily, allowing air to mix with the fluid. Side bars with lower leg members on the outer surface of the cup member space the said member from the casing. A removable cover protects the device when not in use.

DESCRIPTION OF THE PREFERRED EMBODIMENT

Figure 1:
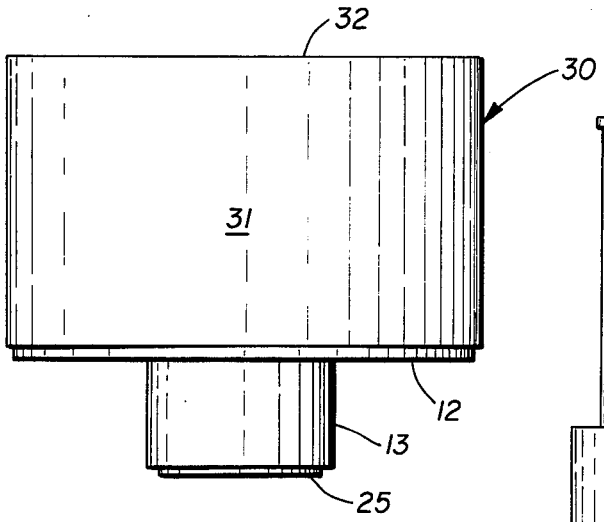
FIG. 1 is an elevational side view of the device embodying the invention with the cover in place as it appears when not in use.
Figure 2:
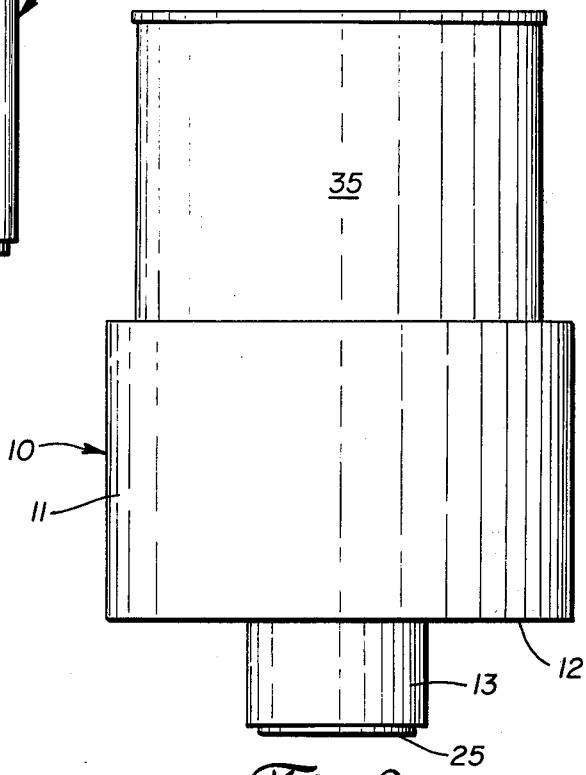
FIG. 2 is an elevational side view of the device with the cover removed, showing a conventional can of motor oil positioned in the device as it appears when in use.

The outer casing 10 has cylindrical side walls 11 integral with a flat bottom 12 provided with an open top and a central opening in its bottom with a sleeve 13 depending from the bottom 12 and communicating with said opening. The opening and sleeve are shown centrally located, but may be off center depending on the requirements of the internal combustion engine with which the device is to be used.

An inner cup member 14 has cylindrical side walls 15 and bottom 16 with central opening 17 of the same size as the opening in the bottom 12. The cup member 14 has attached to its side walls 15 a plurality of spacer bars 20 which extend downwardly beyond the bottom 16 to form legs 21 which space the cup member from the casing walls 11 and bottom 12. The space between the respective side walls is designated 23. The cup has openings 22 in its bottom 16.

Figure 4:
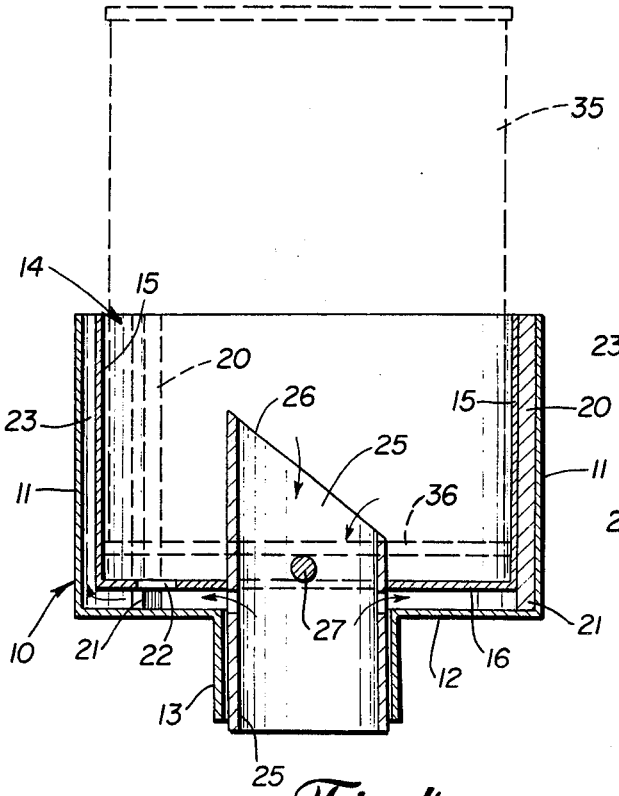
FIG. 4 is a transverse vertical sectional view in the plane of the line 4—4 of FIG. 3, and showing the can in broken lines.
Figure 3:
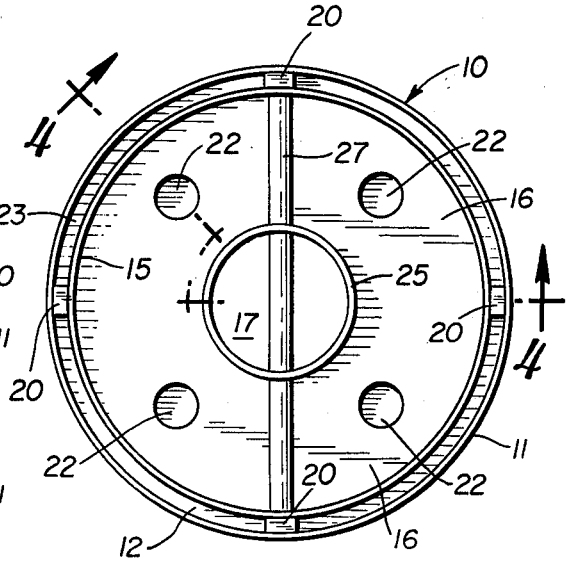
FIG. 3 is a top plan view of the uncovered device.

The oil dispensing and can piercing tube comprises a tubular part 25 with beveled cutting edge 26 defining an opening extending through the tube so that the beveled edge 26 is within the cup member and the lower end of the tube is below the bottom 12 of the casing 10 as shown in FIG. 4. The piercing tube is held in place by a pin 27 which extends through holes located to retain the pin 27 above and resting on the bottom 16 of the cup member. The pin is made of magetic material and serves to attract and hold particles of ferrous matter for later removal. The pin also serves to separate the oil flow through the tube 25 momentarily to allow air, passing upwardly or downwardly with the fluid, to mix with the fluid; thereby preventing creation of a vacuum and preventing fluid overflow in the unit.

A cover 30 has side walls 31, closed top 32, and an open bottom, shaped to fit over the casing 10. The oil can 35 has an end wall 36 that is pierced by the tube 25 for dispensing the oil.

The sleeve 13 fits into a crank case intake pipe (not shown) or other part designed to receive oil. It usually is located centrally of the bottom 12, but may be offset. The assembled device, as shown in FIG. 4, is placed in position, and then the closed oil can 35 is placed, end 36 down, in the cup 15 and forced down on the cutting edge 26. Oil flows into the tube 25 and downwardly into the crank case pipe on which it is positioned, while air flows from the crank case through tube into the space between bottoms 12 and 16 and into space 23 between side walls 11 and 15 of the casing and cup, respectively. The tube 25 may have openings in its side wall as shown in FIG. 4 for this purpose where the tube communicates with said space between the bottoms of the cup member and side walls of the casing. The parts thus are assembled, used and removed (if desired) without spilling oil and without contamination of surfaces which require handling. The oil can is placed in dispensing position before it is opened by the piercing tool 25 within the cup, and no spillage is possible. A quick uniform flow of oil is ensured.

I claim:

1. A device for filling a crank case of transmission of an internal combustion engine with oil dispensed from a can comprising:

a. an open top casing having a cylindrical side wall and a bottom with an opening therein, b. a cup member in the casing having an opening in its bottom registering with the opening in the casing bottom, c. an oil dispensing tube having an oil can piercing upper end facing upwardly in the cup and extending downwardly through the cup and casing bottom openings, d. means mounting the tube in the cup to receive oil from a can pierced by the tube and to dispense it through the tube lower end, and e. spacing means between the cup member and casing side wall and bottom for maintaining shape and alignment of the cup member relative to the casing during the piercing of the oil can on said oil can piercing upper end of the dispensing tube, said spacing means comprising a plurality of side bars connected to the sides of the cup member for preventing deformation of the cup member during piercing of said oil can, the side bars extending downwardly below the bottom of the cup member and forming bottom spacing legs between cup member and casing and maintaining alignment of said dispensing tube with respect thereto.

2. A device for filling a crank case or transmission of an internal combustion engine with oil dispensed from a can comprising:

a. an open top casing having a cylindrical side wall and a bottom with an opening therein, b. a cup member in the casing having an opening in its bottom registering with the opening in the casing bottom, c. means spacing the cup member from the casing side wall and bottom providing air passages between them, d. an oil dispensing tube having an oil can piercing upper end facing upwardly in the cup and extending downardly through the cup and casing bottom openings, and having an opening in its side communicating with said air passages between the cup member and casing, and e. a pin mounting the tube in the cup to receive oil from a can pierced by the tube and to dispense it through the tube lower end, said pin extending through the tube and having ends bearing on the bottom of the cup member.

3. The device defined by claim 2, in which the pin is made of magnetic material which attracts ferrous matter.

4. The device defined by claim 2, in which the pin is located to separate the oil flow passing from the oil can through the tube.

* * * * *